US011486015B2

(12) United States Patent
Perko et al.

(10) Patent No.: US 11,486,015 B2
(45) Date of Patent: Nov. 1, 2022

(54) METHOD FOR PRODUCING A STEEL MATERIAL, AND STEEL MATERIAL

(71) Applicant: voestalpine BÖHLER Edelstahl GmbH & Co. KG, Kapfenberg (DE)

(72) Inventors: Jochen Perko, Kapellen (DE); Michael Haspel, Kapfenberg (DE); Patric Schütz, Leoben (DE)

(73) Assignee: VOESTALPINE BÖHLER EDELSTAHL GMBH & CO. KG, Kapfenberg (DE)

( * ) Notice: Subject to any disclaimer, the term of this patent is extended or adjusted under 35 U.S.C. 154(b) by 473 days.

(21) Appl. No.: 16/302,141

(22) PCT Filed: May 11, 2017

(86) PCT No.: PCT/EP2017/061290
§ 371 (c)(1),
(2) Date: Nov. 16, 2018

(87) PCT Pub. No.: WO2017/198530
PCT Pub. Date: Nov. 23, 2017

(65) Prior Publication Data

US 2019/0211410 A1 Jul. 11, 2019

(30) Foreign Application Priority Data

May 19, 2016 (DE) ..... 10 2016 109 253.3

(51) Int. Cl.
*C21D 6/00* (2006.01)
*C21D 1/18* (2006.01)
(Continued)

(52) U.S. Cl.
CPC ..... *C21D 6/008* (2013.01); *C21D 1/18* (2013.01); *C21D 1/26* (2013.01); *C21D 6/004* (2013.01);
(Continued)

(58) Field of Classification Search
CPC ..... C21D 6/008; C21D 6/005; C21D 6/007; C21D 6/004; C21D 1/18; C21D 1/26;
(Continued)

(56) References Cited

U.S. PATENT DOCUMENTS 3,622,307 A 11/1971 Clarke
5,496,421 A * 3/1996 Hashizume ..... C22C 38/42 148/326

(Continued)

FOREIGN PATENT DOCUMENTS

EP 0257780 A2 3/1988
EP 0649915 A1 4/1995

(Continued)

OTHER PUBLICATIONS

PCT International Preliminary Report on Patentability for corresponding International Application Serial No. PCT/EP2017/061290, dated Nov. 20, 2018, pp. 1-8.

*Primary Examiner* — John A Hevey

(74) *Attorney, Agent, or Firm* — Tarolli, Sundheim, Covell & Tummino LLP

(57) ABSTRACT

The invention relates to a method for producing a steel material, particularly a corrosion-resistant steel material for pumps and similar, in which a steel corresponding to the following analysis (in wt. %) is smelted: C<0.050; Si<0.70; Mn<1.00; P<0.030; S<0.010; Cr=14-15.50; Mo=0.30-0.60; Ni=4.50-5.50; V<0.20; W<0.20; Cu=2.50-4.00; Co<0.30; Ti<0.05; Al<0.05; Nb<0.05; Ta<0.05; N<0.05.

5 Claims, 7 Drawing Sheets

Table 1 Chemical analysis of standard materials (based on EN 10088-3) in comparison to the new material 15-5MOD

| Alloy | C | Si | Mn | P | S | Cr | Mo | Ni | V | W | Cu | Co | Ti | Al | Ta | Nb | N |
|---|---|---|---|---|---|---|---|---|---|---|---|---|---|---|---|---|---|
| Sample 15-5MOD | 0.020 | 0.25 | 0.43 | 0.020 | 0.0004 | 14.3 | 0.38 | 5.10 | 0.08 | < 0.05 | 3.18 | < 0.05 | <0.005 | 0.010 | <0.005 | <0.005 | 0.0084 |
| 15-5MOD | < 0.050 | < 0.70 | < 1.00 | < 0.030 | < 0.010 | 14.00 - 15.50 | 0.30 - 0.60 | 4.50 - 5.50 | < 0.20 | < 0.20 | 2.50 - 4.00 | < 0.30 | < 0.05 | < 0.05 | < 0.05 | < 0.05 | < 0.05 |
| DIN 1.4313 | < 0.05 | < 0.70 | < 1.50 | < 0.040 | < 0.015 | 12.00 - 14.0 | 0.30 - 0.70 | 3.50 - 4.50 | | | | | | | | | ≥ 0.020 |
| DIN 1.4418 | < 0.06 | < 0.70 | < 1.50 | < 0.040 | < 0.030 | 15.0 - 17.0 | 0.80 - 1.30 | 4.0 - 6.0 | | | | | | | | | ≥ 0.020 |
| DIN 1.4542 | < 0.07 | < 0.70 | < 1.50 | < 0.040 | < 0.030 | 15.0 - 17.0 | < 0.60 | 3.0 - 5.0 | | | 3.0 - 5.0 | | | | | 5x C to 0.45 | |

(51) Int. Cl.

| | |
|---|---|
| ***C21D 1/26*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/16*** | (2006.01) |
| ***C22C 38/08*** | (2006.01) |
| ***C22C 38/10*** | (2006.01) |
| ***C22C 38/18*** | (2006.01) |
| ***C22C 38/00*** | (2006.01) |
| ***C22C 38/48*** | (2006.01) |
| ***C22C 38/50*** | (2006.01) |
| ***C22C 38/52*** | (2006.01) |

(52) U.S. Cl.
CPC ..... *C21D 6/005* (2013.01); *C21D 6/007* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/105* (2013.01); *C22C 38/16* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/001* (2013.01); *C21D 2211/005* (2013.01); *C21D 2211/008* (2013.01)

(58) Field of Classification Search
CPC ..... C21D 2211/001; C21D 2211/005; C21D 2211/008; C21D 8/0263; C22C 38/16; C22C 38/08; C22C 38/105; C22C 38/18; C22C 38/001; C22C 38/002; C22C 38/48; C22C 38/50; C22C 38/52; C22C 38/02; C22C 38/04; C22C 38/06; C22C 38/42; C22C 38/44; C22C 38/46
See application file for complete search history.

(56) References Cited

U.S. PATENT DOCUMENTS

| | | | | |
|---|---|---|---|---|
| 2013/0014864 | A1* | 1/2013 | Teraoka | C22C 38/001 148/609 |
| 2015/0354022 | A1* | 12/2015 | Eguchi | C21D 6/008 148/592 |
| 2017/0029912 | A1* | 2/2017 | De Carvalho | C22C 38/06 |

FOREIGN PATENT DOCUMENTS

| | | | | |
|---|---|---|---|---|
| EP | 0742289 | A1 * | 11/1996 | C22C 38/48 |
| EP | 0742289 | A1 | 11/1996 | |
| JP | H07179943 | A | 7/1995 | |
| WO | 0053821 | | 9/2000 | |

* cited by examiner

Table 1 Chemical analysis of standard materials (based on EN 10088-3) in comparison to the new material 15-5MOD

| Alloy | C | Si | Mn | P | S | Cr | Mo | Ni | V | W | Cu | Co | Ti | Al | Ta | Nb | N |
|---|---|---|---|---|---|---|---|---|---|---|---|---|---|---|---|---|---|
| Sample 15-5MOD | 0.020 | 0.25 | 0.43 | 0.020 | 0.0004 | 14.3 | 0.38 | 5.10 | 0.08 | < 0.05 | 3.18 | < 0.05 | <0.005 | 0.010 | <0.005 | <0.005 | 0.0084 |
| 15-5MOD | < 0.050 | < 0.70 | < 1.00 | < 0.030 | < 0.010 | 14.00 - 15.50 | 0.30 - 0.60 | 4.50 - 5.50 | < 0.20 | < 0.20 | 2.50 - 4.00 | < 0.30 | < 0.05 | < 0.05 | < 0.05 | < 0.05 | < 0.05 |
| DIN 1.4313 | < 0.05 | < 0.70 | < 1.50 | < 0.040 | < 0.015 | 12.00 - 14.0 | 0.30 - 0.70 | 3.50 - 4.50 | | | | | | | | | ≥ 0.020 |
| DIN 1.4418 | < 0.06 | < 0.70 | < 1.50 | < 0.040 | < 0.030 | 15.0 - 17.0 | 0.80 - 1.30 | 4.0 - 6.0 | | | | | | | | | ≥ 0.020 |
| DIN 1.4542 | < 0.07 | < 0.70 | < 1.50 | < 0.040 | < 0.030 | 15.0 - 17.0 | < 0.60 | 3.0 - 5.0 | | | 3.0 - 5.0 | | | | | 5x C to 0.45 | |

Fig. 1

Table 2 Mechanical testing of 15-5MOD in the transverse direction, 640 x 540 mm, tempering at 520ºC

| Hardening | Tempering | Block zone | Testing layer | Rm [MPa] | $Rp_{0.2}$ [MPa] | $A_4$ [%] | $Z_4$ [%] | Toughness Av (20ºC) | Toughness Av (-40ºC) | Delta ferrite after AMS 2315 (R-Z) [%] |
|---|---|---|---|---|---|---|---|---|---|---|
| 950ºC | 520ºC | S | R | 1050 | 1022 | 20.3 | 69.4 | 200 / 196 / 201 | 107 / 129 / 116 | 0 |
| | | | 1/2 R | 1048 | 1019 | 15.4 | 55.7 | 207 / 205 / 200 | 195 / 122 / 98 | 0 |
| | | | Z | 1047 | 1016 | 15.1 | 53.7 | 202 / 200 / 206 | 201 / 201 / 200 | 0 |
| | | M | R | 1037 | 1011 | 17.6 | 70.3 | 209 / 209 / 202 | 201 / 203 / 207 | 0 |
| | | | 1/2 R | 1053 | 1022 | 15.6 | 55.6 | 198 / 201 / 188 | 137 / 175 / 187 | 0 |
| | | | Z | 1046 | 1015 | 14.5 | 49.8 | 176 / 190 / 185 | 179 / 69 / 135 | 0 |
| | | B | R | 1049 | 1016 | 17.6 | 65.7 | 208 / 209 / 210 | 202 / 196 / 201 | 0 |
| | | | 1/2 R | 1041 | 1013 | 15.6 | 56.1 | 206 / 207 / 194 | 177 / 204 / 179 | 0 |
| | | | Z | 1026 | 997 | 15.0 | 50.1 | 199 / 206 / 191 | 189 / 179 / 191 | 0 |

Fig. 2

Table 3 Mechanical testing of 15-5MOD in the transverse direction, 640 x 540 mm, tempering at 485ºC

| Hardening | Tempering | Block zone | Testing layer | Rm [MPa] | $Rp_{0.2}$ [MPa] | $A_4$ [%] | $Z_4$ [%] | Toughness Av (20ºC) | Toughness Av (-40ºC) | Delta ferrite after AMS 2315 (R-Z) [%] |
|---|---|---|---|---|---|---|---|---|---|---|
| 950ºC | 485ºC | S | R | 1133 | 1094 | 16.9 | 63.8 | 183 / 181 / 175 | 174 / 136 / 99 | 0 |
| | | | 1/2 R | 1137 | 1095 | 15.6 | 56.3 | 178 / 147 / 185 | 120 / 100 / 71 | 0 |
| | | | Z | 1137 | 1096 | 14.8 | 55.9 | 173 / 170 / 182 | 146 / 116 / 83 | 0 |
| | | M | R | 1105 | 1105 | 14.1 | 60.9 | 167 / 160 / 184 | 160 / 175 / 188 | 0 |
| | | | 1/2 R | 1103 | 1103 | 15.2 | 55.8 | 159 / 171 / 179 | 71 / 100 / 82 | 0 |
| | | | Z | 1101 | 1101 | 14.1 | 47.1 | 165 / 160 / 170 | 97 / 123 / 100 | 0 |
| | | B | R | 1141 | 1098 | 16.5 | 62.2 | 173 / 178 / 162 | 166 / 129 / 100 | 0 |
| | | | 1/2 R | 1132 | 1092 | 14.2 | 58.6 | 167 / 176 / 171 | 122 / 118 / 156 | 0 |
| | | | Z | 1119 | 1077 | 14.8 | 51.1 | 160 / 172 / 163 | 109 / 147 / 123 | 0 |

Fig. 3

Table 4 Mechanical testing of DIN 1.4418, 640 x 540 mm, in the transverse direction

| Hardening | Tempering | Block zone | Testing layer | Rm [MPa] | $Rp_{0.2}$ [MPa] | $A_4$ [%] | $Z_4$ [%] | Toughness Av (20ºC) | Toughness Av (-40ºC) | Delta ferrite after AMS 2315 (R-Z) [%] |
|---|---|---|---|---|---|---|---|---|---|---|
| 950ºC | 515ºC | S | R<br>Z | 1067<br>1089 | 1025<br>1014 | 18.5<br>18.0 | 65.0<br>56.3 | 145 / 147 / 160<br>133 / 163 / 154 | 131 / 137 / 136<br>79 / 69 / 87 | 0<br>1.5 |
| | | M | R<br>Z | 1108<br>1108 | 1042<br>1021 | 21.7<br>22.3 | 61.7<br>64.1 | 154 / 144 / 145<br>155 / 161 / 150 | 123 / 114 / 98<br>86 / 75 / 38 | 0<br>0.5 |
| | | B | R<br>Z | 1042<br>1006 | 1016<br>1016 | 18.2<br>17.3 | 63.2<br>62.1 | 152 / 137 / 156<br>158 / 146 / 146 | 119 / 122 / 113<br>115 / 114 / 111 | 0<br>0.2 |

Fig. 4

Table 5 Mechanical testing of DIN 1.4313, 640 x 540 mm, in the transverse direction

| Hardening | Tempering | Block zone | Testing layer | Rm [MPa] | $Rp_{0.2}$ [MPa] | $A_4$ [%] | $Z_4$ [%] | Toughness Av (20ºC) | Toughness Av (-40ºC) | Delta ferrite after AMS 2315 (R-Z) [%] |
|---|---|---|---|---|---|---|---|---|---|---|
| 950ºC | 475ºC | S | R | 1108 | 976 | 20.6 | 67.0 | 227 / 229 / 220 | 26 / 35 / 87 | 0 |
| | | | 1/2 R | 1100 | 975 | 19.3 | 67.1 | 220 / 217 / 215 | 25 / 16 / 18 | 0 |
| | | | Z | 1086 | 936 | 20.9 | 67.4 | 217 / 219 / 227 | 24 / 22 / 48 | 0 |
| | | M | R | 1114 | 955 | 22.2 | 72.6 | 235 / 233 / 234 | 16 / 14 / 16 | 0 |
| | | | 1/2 R | 1121 | 975 | 20.0 | 64.9 | 224 / 137 / 230 | 17 / 20 / 12 | 0 |
| | | | Z | 1121 | 974 | 18.7 | 64.7 | 100 / 211 / 169 | 10 / 14 / 34 | 0 |
| | | B | R | 1093 | 941 | 22.2 | 73.2 | 212 / 199 / 222 | 22 / 38 / 14 | 0 |
| | | | 1/2 R | 1100 | 956 | 20.7 | 66.7 | 224 / 223 / 225 | 16 / 20 / 12 | 0 |
| | | | Z | 1114 | 968 | 20.2 | 65.0 | 244 / 165 / 235 | 30 / 16 / 22 | 0 |

Fig. 5

Table 6 Mechanical testing of DIN 1.4252, dimensions 520 x 280 mm, in the transverse direction

| Hardening | Tempering | Block zone | Testing layer | Rm [MPa] | $Rp_{0.2}$ [MPa] | $A_4$ [%] | $Z_4$ [%] | Toughness Av (20ºC) | Toughness Av (-40ºC) | Delta ferrite after AMS 2315 (R-Z) [%] |
|---|---|---|---|---|---|---|---|---|---|---|
| 950ºC | 580ºC | M | R<br>1/2 R<br>Z | 1120<br>1121<br>1115 | 1051<br>1012<br>993 | 20.6<br>17.1<br>17.4 | 52.7<br>44.4<br>44.0 | 29 / 26 / 24<br>22 / 19 / 16<br>14 / 14 / 13 | 10 / 8 / 7<br>11 / 8 / 7<br>6 / 8 / 5 | < 0.5 |

Fig. 6

Table 7 Mechanical testing of sample 15-5MOD in the transverse direction, 640 x 540 mm, hardening at 450ºC

| Hardening | Tempering | Block zone | Testing layer | Rm [MPa] | $Rp_{0.2}$ [MPa] | $A_4$ [%] | $Z_4$ [%] | Toughness Av (-40ºC) | Delta ferrite after AMS 2315 (R-Z) [%] |
|---|---|---|---|---|---|---|---|---|---|
| 950ºC | 450ºC | **S** | 1/2 R | 1309<br>1303 | 1190<br>1177 | 15.1<br>15.2 | 65.5<br>71.0 | 20 / 27 / 33<br>49 / 63 / 78 | < 0.5 |

Fig. 7

Table 8 Resistance to erosion corrosion:

Tensile test values of the tested samples and mass loss

Medium: boiling 20% ethanoic acid, test duration 24 h,

PH = 1.6 (acidified with H2SO4)

| Material | Rm | Rp0.2% | A4 | Z |
|---|---|---|---|---|
| DIN 1.4313 | 1113 | 942 | 19.3 | 69.1 |
| DIN 1.4418 | 1085 | 984 | 18.7 | 44.7 |
| 15-5MOD, 485ºC | 1119 | 1071 | 19.3 | 73.3 |
| 15-5MOD, 520ºC | 1056 | 1006 | 17.2 | 67.1 |
| DIN 1.4542 | 1108 | 1068 | 16.8 | 68.4 |

| Material | Mass before testing (g) | Mass after testing (g) | Mass loss [g] | Result in $gm^2h$ |
|---|---|---|---|---|
| DIN 1.4313 | 23.10668 | 22.63705 | 0.46963 | 11.01 |
| | 23.07869 | 22.59528 | 0.48341 | 11.18 |
| DIN 1.4418 | 23.97674 | 23.97674 | 0.00000 | 0.00 |
| | 23.72929 | 23.72836 | 0.00093 | 0.02 |
| 15-5MOD, 485ºC | 23.31939 | 23.31901 | 0.00038 | 0.01 |
| | 23.68716 | 23.68672 | 0.00044 | 0.01 |
| 15-5MOD, 520ºC | 23.65176 | 23.64894 | 0.00372 | 0.09 |
| | 23.28609 | 23.28269 | 0.00340 | 0.08 |
| DIN 1.4542 | 22.65869 | 22.65829 | 0.00040 | 0.01 |
| | 22.70889 | 22.70855 | 0.00034 | 0.01 |

Fig. 8

METHOD FOR PRODUCING A STEEL MATERIAL, AND STEEL MATERIAL

To produce pumps and the like that are exposed to powerfully corrosive environments, it is known to use steels from which the corresponding blocks for the pumps are produced, which are then used to produce the pumps and pump parts, often by means of material-removing machining.

The steels used for this are in particular standardized and the above-mentioned subassemblies are chiefly made using the steels DIN 1.4542, DIN 1.4418, and also DIN 1.4313.

Because of the considerably low price level on the one hand and also because of the very high demand on the world market, these steels are, to the greatest extent possible, melted conventionally.

Due to the low price level and the global demand, materials that are produced with corresponding remelting methods (ESU or VLBO) cannot be used in all countries.

In order to produce pump blocks, very large block formats are required so that the cast weights are often greater than 10 t. This means that a suitable material must be designed so that even when using conventional block formats and conventional melting, the most uniform possible product properties can be achieved due to the low segregation tendency. Segregations are basically unwanted here because segregations can be the starting point for mechanical inhomogeneities and possibly cracking. In addition, deviations in corrosion resistance properties can also occur in the vicinity of segregations.

The steel DIN 1.4418 has a high yield strength ($Rp_{0.2}$%) of approximately 1000 MPa; the steel DIN 1.4418 can achieve a very high low-temperature toughness, which typically lies in the range between 50 and 150 J (Charpy V notch) of notched bar impact work at −40° C. This high level of toughness is required due to the cavitation that occurs in pumps.

The material DIN 1.4542 with the same yield strength cannot come anywhere close to achieving this level of toughness and usually remains at only single-digit notched bar impact work values at −40° C.

The steel DIN 1.4313 is also used for pump blocks, but because its alloy level is lower than that of DIN 1.4418, can only achieve yield strengths of between 900 and 1000 MPa when tempered to its maximum strength level. When this material is used with its maximum strength level, however, it is only possible to achieve a low toughness level at low temperatures; in addition, the corrosion resistance by the alloy is significantly lower in comparison to the other two steels. The materials DIN 1.4313 and DIN 1.4418 in this case are nickel martensitic secondary hardening alloys whereas the material DIN 1.4542 is a nickel martensitic copper hardening material.

The object of the invention is to create a material, which, even at very high cast weights, exhibits an improved strength at a very low toughness level, while also having a high corrosion resistance.

The object is attained with a method for producing a steel material having the features of claim 1.

Advantageous modifications are disclosed in the dependent claims.

Another object of the invention is to create a material that has strengths that are correspondingly similar to or greater than those of known steels, but has a higher toughness level and an improved corrosion resistance.

This object is attained by a steel material having the features of claim 6.

The inventors' stated goal was to develop a material that has a strength greater than or equal to that of DIN 1.4418 or DIN 1.4542, which already has a very high intrinsic strength, but also achieves or exceeds the very high toughness level of DIN 1.4418, but on the other hand, also exceeds the corrosion resistance of the significantly less strong DIN 1.4313.

The goal in this context, however, is also to achieve these product properties with conventional melting, but for the analysis to be set up so that it is also possible to achieve a high-purity remelting variant (ESU or VLBO). Such a high-purity remelting variant, due to its considerably lower content of smaller-size oxide inclusions, has particular advantages with regard to fatigue properties for special applications in the design of machines and apparatuses that are subjected to highly dynamic loads, as is the case, for example, in compressors or centrifuges. By means of remelting in a vacuum arc furnace (VLBO), which is the usual remelting technology for components that are subjected to powerful stresses in aviation applications, by reducing the defect sizes in the material according to the invention, the fatigue strength of the material can be increased. This effect is of great importance primarily when the material according to the invention is used at high strengths in aviation and aerospace applications.

In order to produce such material properties, it is necessary to abandon both the nickel martensitic secondary hardening method on the one hand and the nickel martensitic copper hardening method on the other and to set off in a new direction.

According to the invention, copper is used for tempering in the new steel material. The inventors have realized that delta ferrite as a structural component reduces toughness; with an optimal ratio of austenite-to-ferrite stabilizing elements, this phase is minimized and for production reasons, every effort is made to keep the presence of the delta ferrite phase to a minimum by means of a suitable casting technology and by carrying out the forming at an optimized temperature.

A niobium stabilization of the kind that is used, for example, in DIN 1.4542 is entirely avoided so that according to the invention, no coarse primary carbides are formed.

The inventors have realized that material concepts such as DIN 1.4542 originated at a time in which the systems engineering in melting metallurgy did not yet ensure the possibility of reducing the carbon content of high-chromium melts.

For this reason, the approach often taken was to bind to the carbon, which had a negative effect on the corrosion resistance, by means of powerful carbide-forming agents such as titanium or niobium through the formation of monocarbides and chromium carbides. This alloying technique was used both with austenitic materials and with martensitic materials such as DIN 1.4542 and even today, is still stipulated in the international standards for this material.

The deliberate step of omitting a stabilization in this alloying system is one of the essential features according to the invention, which make it possible to achieve a material with the property profile according to the invention and with the above-mentioned manufacturing options.

The invention will be explained below by way of example based on the drawings.

In the drawings:

Table 1 shows the chemical analysis of the standard materials based on EN 10088-3 in comparison to the material according to the invention (15-5MOD);

Table 2 shows the mechanical properties of the material according to the invention in the transverse direction with a tempering at 520° C.;

Table 3 shows the mechanical properties of the material according to the invention in the transverse direction with a tempering at 485° C.;

Table 4 shows the mechanical properties of a standard material that is not according to the invention in the transverse direction;

Table 5 shows the mechanical properties of another standard material in the transverse direction;

Table 6 shows the mechanical properties of another standard material in the transverse direction;

Table 7 shows the mechanical properties of the material according to the invention in the transverse direction with a tempering at 450° C.;

Table 8 shows the resistance to erosion corrosion based on tensile test parameters of the samples tested and a comparison of the mass loss of standard materials to that of the material according to the invention.

Table 1 shows a comparison of all of the above-mentioned materials to the material according to the invention (15-5MOD). The material according to the invention was conventionally melted and a plurality of flat bars with the dimensions 640×540 mm were produced by means of forging. After the forging, the material is solution annealed at 950°, hardened, and then tempered.

The tempering temperatures were 485° in one case and 520° C. in the other case.

After the heat treatment, the bars are cut in the middle and then undergo complete mechanical testing in the zones of the bottom, the middle, and the cropped region.

The mechanical testing in this case is composed of a tensile test at room temperature, a notched bar impact test (Charpy V notch) at room temperature, and a notched bar impact test (Charpy V notch) at −40° C.

The analysis according to Table 1 shows that in the desired state of the steel material according to the invention, in particular the manganese content and phosphorus content have been removed, in particular also including removal of the sulfur content. The chromium content is between that of the materials DIN 1.4313 and DIN 1.4418 and finally, the nitrogen content is particularly low and copper is also present.

The mechanical properties in the two tempered states are shown in Tables 2 and 3 and demonstrate that the strength differs by approx. 100 MPa and with the specified heat treatments, yield strengths of approx. 1000 and 1100 MPa, respectively, can be achieved. The exceptional feature of the material according to the invention, however, is a strikingly high toughness level, even at low temperatures.

This outstanding combination of properties is based on the insight according to the invention that by and large, delta ferrite can be avoided through an appropriate analysis configuration. In addition, with the invention, the maximum quantity of niobium is sharply limited so that a niobium stabilization has to be ruled out and the niobium content is so low that toughness-reducing hard phases are avoided.

For the sake of comparison, comparison data of the materials D 1.4313 and D 1.4418 are shown in Table 4 and Table 5; these, too, have been determined based on forged bars in the same dimensional range.

In this case, the steel material according to the invention has the best combination of strength and toughness.

Table 6 shows the results of a smaller DIN 1.4542 forged bar with the dimensions 520×280, which achieves only a fraction of the toughness at the same strength.

In the context of the development of the material according to the invention 15-5MOD, the maximum strength potential that could be achieved with the specified analysis was studied. It turned out that through a reduction of the tempering temperature to 450° C., a further strength increase to a yield strength of approx. 1177-1190 MPa can be achieved. In this extremely strong state, the toughness determined by means of the notched bar impact test at −40° C. is naturally reduced relative to a tempering at 485° C., although at 20 J to 78 J (Table 7), the material exhibits a notched bar impact work level that is still several times higher than that of the material DIN 1.4542 at a yield strength that is more than 100 MPa higher so that even this WBH state must be considered to be extremely relevant from a practical standpoint despite the lower low-temperature toughness.

Since the material, in addition to having a high strength and an accompanying high toughness, must also have a sufficient corrosion resistance, additional corrosion tests were also conducted.

The mass loss due to erosion corrosion was determined in 20% ethanoic acid, which was acidified to pH—1.6 with sulfuric acid. The test lasted for 24 hours. The results (Table 8) show that the materials DIN 1.4418, DIN 1.4542, and the material according to the invention exhibit hardly any erosion and their corrosion resistances under these conditions can also be considered to be equivalent. As expected, the material 1.4313 exhibits a significant material loss due to its lower alloy content. In this case, it is particularly apparent that the material according to the invention is able to improve both the strength and the toughness even further while retaining the same level of corrosion resistance.

With the method according to the invention, the material is conventionally melted into large block formats weighing up to >10 t with an analysis corresponding to Table 1.

Then, the material is shaped in the range from 800 to 1250° C., followed by a heat treatment.

The heat treatment is comprised of a solution annealing at 850 to 1050° C., a subsequent hardening, a subsequent cooling, and tempering at 450 to 600° C.; the temperature range of 450 to 520° C. is preferable for the sake of achieving a maximum of strength.

The structure of the material according to the invention is then composed of martensite with a maximum of 1% delta ferrite; it is free of primary hard phases (mainly based on niobium, tantalum, titanium, vanadium); and the tempered austenite content is at most 8%.

The material according to the invention is primarily used for corrosion-resistant pump blocks, but can also be used in general machine and apparatus construction.

According to the invention, with increased demands on fatigue strength, particularly in subassemblies that are subjected to highly dynamic loads or in the case of safety-critical structural components in the aviation and aerospace industry, the material can also be produced in the form of a high-purity remelting product in accordance with the ESU or VLBO method. The purity grade improvement associated with the remelting yields the sufficiently well-known improvements in fatigue properties due to a reduction in the defect sizes in the material.

With the invention, it is advantageous that through a very precise analysis management on the one hand and through an implementation of the analysis and the reduction of the delta ferrite and primary hard phases, a material is produced, which achieves very high strength, corrosion resistance, and toughness in a way that could not previously be combined with one another.

The invention claimed is:

1. A method for producing a corrosion-resistant steel material for pumps, comprising:

melting components of the steel material conventionally or using electro-slag remelting or vacuum arc remelting;

forming the steel material at 800° C. to 1250° C.;

heat treating the steel material by solution annealing at 850° C. to 1050° C.;

cooling the steel material;

tempering the steel material at 450° C. to 600° C., wherein the steel material is composed of martensite with at most 1 vol. % delta ferrite and at most 8 vol. % tempered austenite and is free of primary hard phases based on niobium, tantalum, titanium, or vanadium, wherein the steel material is further composed of (in wt %):

C<0.050;

Si<0.70;

Mn<1.00;

P<0.030;

S<0.010;

Cr=14-15.50;

Mo=0.30-0.60;

Ni=4.50-5.50;

V<0.20;

W<0.20;

Cu=2.50-4.00;

Co<0.30;

Ti<0.05;

Al<0.05;

Nb<0.05;

Ta<0.05;

N<0.05;

and the remainder iron and melting-related impurities.

2. The method according to claim 1, wherein the steel material is composed of (in wt %):

C<0.030;

Si<0.40;

Mn<0.60;

P<0.025;

S<0.005;

Cr=14.20-14.60;

Mo=0.30-0.45;

Ni=4.80-5.20;

V<0.10;

W<0.10;

Cu=3.00-3.70;

Co<0.15;

Ti<0.010;

Al<0.030;

Nb<0.02;

Ta<0.02;

N<0.02;

and the remainder iron and melting-related impurities.

3. The method according to claim 1, characterized in that at a tempering temperature of 485° C., the material achieves a yield strength of 1100 MPa with a toughness of over 60 J at −40° C.

4. The method according to claim 1, wherein the tempering the steel material occurs at from 450° C. to 520° C.

5. The method according to claim 1, wherein the tempering the steel material occurs at from 485° C. to 520° C.

* * * * *